US007188874B2

(12) United States Patent
Chiang

(10) Patent No.: US 7,188,874 B2
(45) Date of Patent: Mar. 13, 2007

(54) SCREEN DOOR HANDLE ACTIVATING ASSEMBLY

(76) Inventor: Fanny Chiang, 11 Fl.-4, No. 16, Chungming S. Rd., West Dist., Taichung (TW)

( * ) Notice: Subject to any disclaimer, the term of this patent is extended or adjusted under 35 U.S.C. 154(b) by 76 days.

(21) Appl. No.: 11/046,800

(22) Filed: Feb. 1, 2005

(65) Prior Publication Data

US 2006/0170227 A1 Aug. 3, 2006

(51) Int. Cl.
*E05B 3/00* (2006.01)

(52) U.S. Cl. ..... 292/336.3; 292/DIG. 46; 292/DIG. 30

(58) Field of Classification Search ..... 292/336.3, 292/DIG. 37, DIG. 30, DIG. 71, DIG. 65, 292/169, 196, 237, 221, 127, 135, 100; 70/224, 70/207

See application file for complete search history.

(56) References Cited

U.S. PATENT DOCUMENTS 1,925,308 A * 9/1933 De Voe ..... 292/221
2,156,513 A * 5/1939 Roedding ..... 292/332
2,321,724 A * 6/1943 Aldeen et al. ..... 292/336.3
3,485,066 A * 12/1969 Waldo ..... 70/141
3,746,384 A * 7/1973 Ripley ..... 293/137
4,732,417 A * 3/1988 Yang ..... 292/142
4,740,022 A * 4/1988 Takahashi ..... 292/217
5,123,687 A * 6/1992 Pfeiffer et al. ..... 292/336.3
5,421,061 A * 6/1995 Kolle et al. ..... 292/336.3
2006/0119112 A1* 6/2006 Lin ..... 292/336.3

* cited by examiner

*Primary Examiner*—Brian E. Glessner
*Assistant Examiner*—Kristina R Gluchowski
(74) *Attorney, Agent, or Firm*—Fei-Fei Chao; Andrews Kurth LLP

(57) ABSTRACT

An activating assembly for a screen door includes an assembly seat securable to the screen door and having a lever movably received in the assembly seat and a first recovery spring a to push the lever back to its original position, a driving rod in connection to the lever such that movement of the lever is able to force the driving rod to cause reaction of a lock device, a base seat securable to the screen door and having a second recovery spring compressibly received inside the base seat and a handle movable relative to the assembly seat and the base seat. The handle has a triangular end abutting the lever such that the movement of the handle is able to force the lever to pivot by the triangular end of the handle and the lock device is activated by movement of the driving rod.

5 Claims, 7 Drawing Sheets

SCREEN DOOR HANDLE ACTIVATING ASSEMBLY

BACKGROUND OF THE INVENTION

1. Field of the Invention

The present invention relates to a screen door handle activating assembly, and more particularly to a handle activating assembly to easily and conveniently open the screen door.

2. Description of Related Art

With reference to FIG. 6, a conventional screen door handle activating assembly is shown and has a handle assembly (90) provided with two extensions (91) extending from a side face of the handle assembly (90) and a driving rod (93) sandwiched between the two extensions (91). The two extensions (91) as well as the driving rod (93) are able to extend through holes (51) defined in a side face of a screen door (50) to connect to a lock device (60). A pushbutton (92) is provided on top of the handle assembly (90) to control movement of the driving rod (93). Therefore, after the conventional activating assembly is mounted on the screen door (50) for controlling activation of the lock device (60), the user will have to push the pushbutton (92) to drive the driving rod (93) to move. As a result of the driving rod (93) movement, the lock device (60) is activated. That is, the user needs to push the pushbutton (92) first to unlock the lock device (60) and then the user pulls the screen door (50) open. Two different steps in connection with two activating forces in different directions are applied to the handle assembly (90) so as to have effective result for the controlling of the lock device (60). The structure thereof is inconvenient for small children and handicapped.

With reference to FIG. 7, another conventional handle activating assembly (90A) is shown and has a base (94) securely attached to a side face of the screen door (50) and having an extension (91) extending into the side face of the screen door (50), and a driving rod (93) extending through the screen door (50) and into a lock device (60) securely attached to a side face of the screen door to be opposite to the base (94). A handle (95) is pivotally connected to the base (94) via an abutting boss (954) from which the driving rod (93) is extended. The handle (95) further has a hook (952) extended into the screen door (50) to detachably connect to a projection (942) formed inside the base (94). Thus when the handle (95) is pulled to pivot relative to the screen door (50), the abutting boss (954) is pushed to drive the driving rod (93) to activate the lock device (60). In the meantime, the connection between the hook (952) and the projection (942) is released. With such a structure, the opening direction of the lock assembly and the opening direction of the screen door is different, which is a waste in energy.

It is noted that to open the screen door (50) via the second conventional structure requires the user to pull the handle (95), but the applied force responsible for the handle movement is irrelevant to the activation of the lock device (60). Thus a major portion of the force applied to open the screen door is wasted in the release of the connection between the hook (952) and the projection (942).

To overcome the shortcomings, the present invention tends to provide an improved screen door handle activating assembly to mitigate the aforementioned problems.

SUMMARY OF THE INVENTION

The primary objective of the present invention is to provide an improved screen door handle activating assembly to easily and conveniently open the screen door.

Other objects, advantages and novel features of the invention will become more apparent from the following detailed description when taken in conjunction with the accompanying drawings.

DETAILED DESCRIPTION OF THE PREFERRED EMBODIMENT

Figure 1:
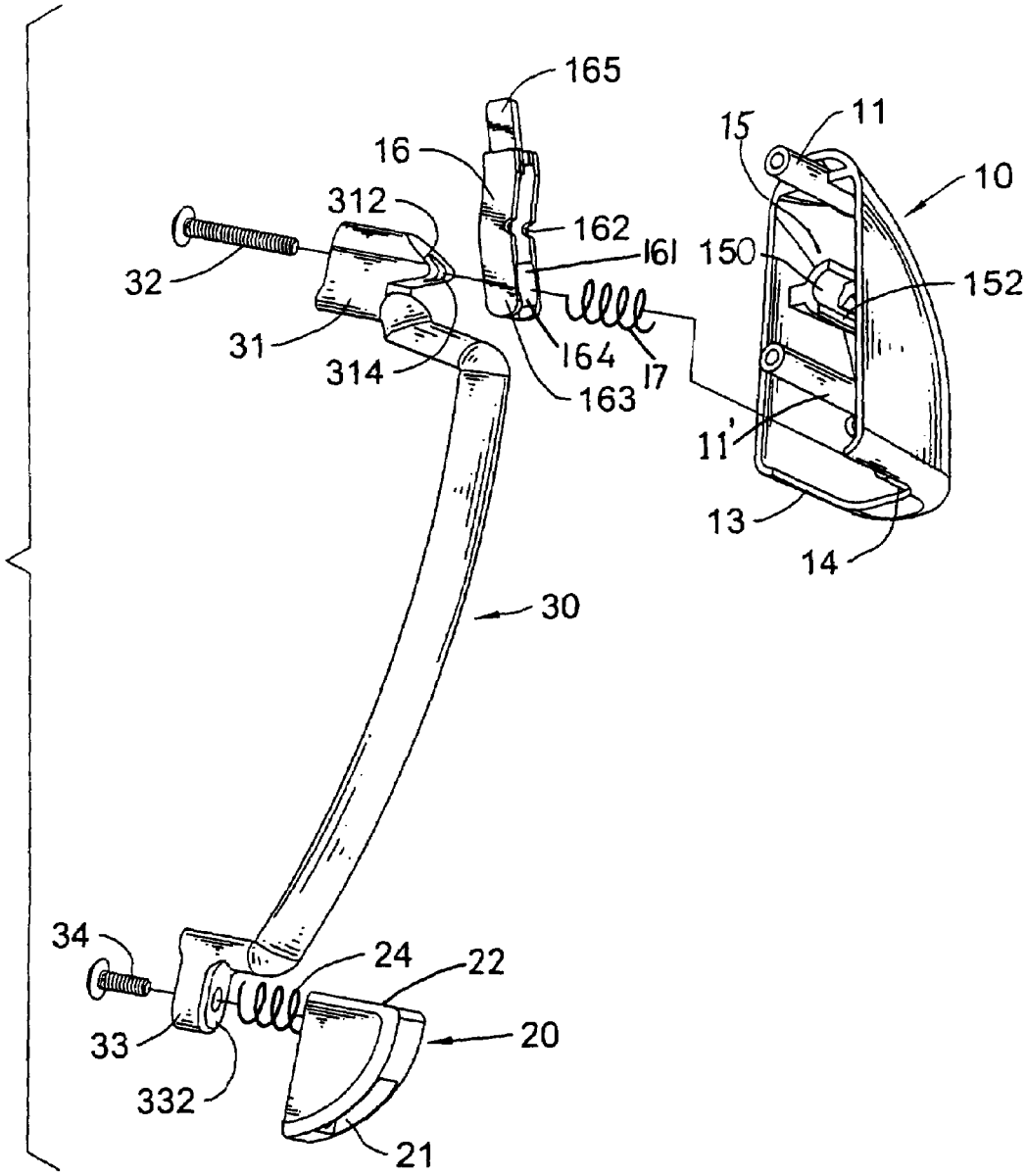
FIG. 1 is an exploded perspective view of the handle activating assembly of the present invention.
Figure 2:
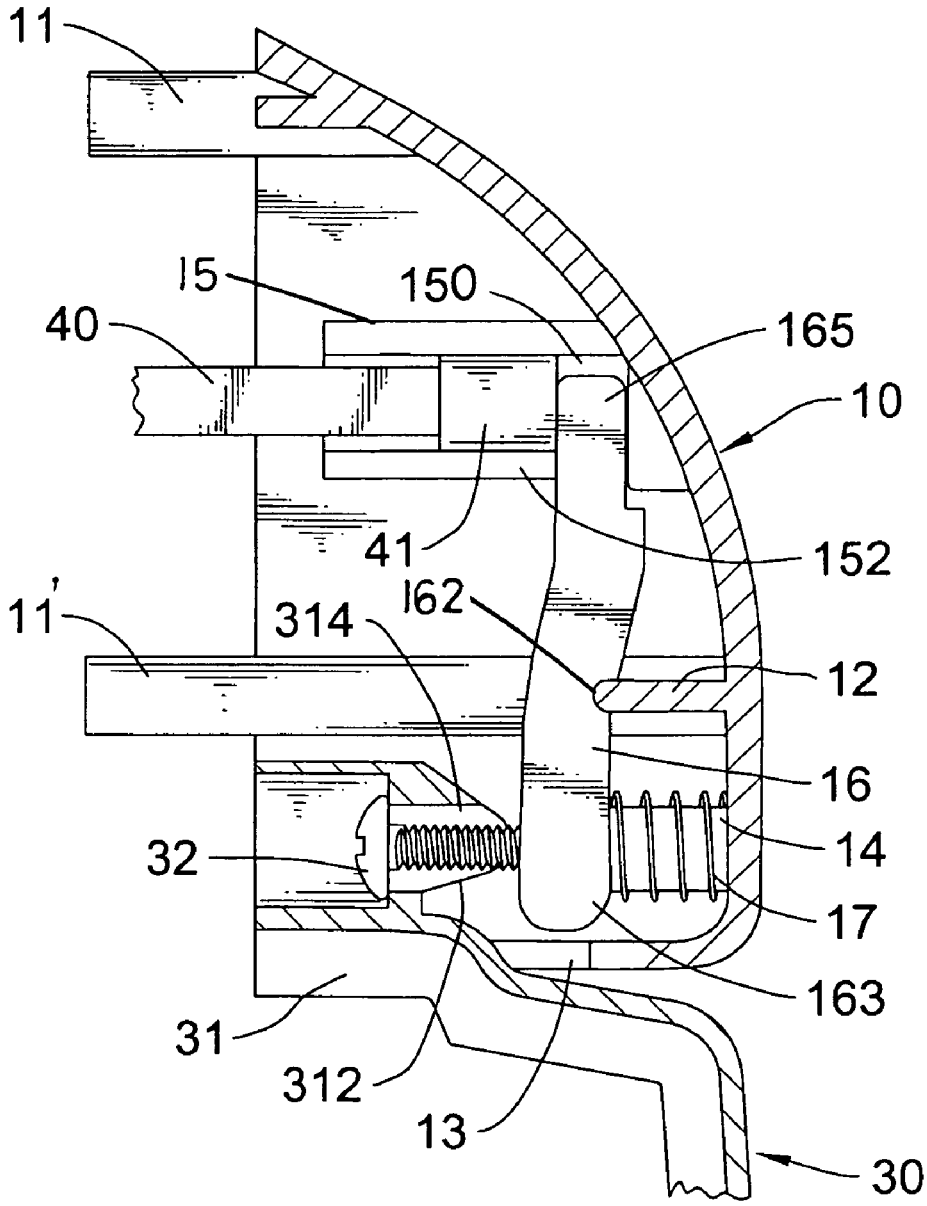
FIG. 2 is a schematic cross sectional view showing the connection between lever and the ribs in the assembly seat.

With reference to FIGS. 1 and 2, the handle activating assembly in accordance with the present invention includes an assembly seat (10), a base seat (20) and a handle (30) sandwiched between the assembly seat (10) and the base seat (20).

The assembly seat (10) has a hollow interior and has a first extension (11) extending from an inner side face of a top portion of the assembly seat (10), a second extension (11') extending from a central portion of the assembly seat (10), two ribs (12) extending from the inner side face of the assembly seat (10) to sandwich the second extension (11'), a first assembly hole (13) defined in a bottom face of the assembly seat (10), a first connection rod (14) formed on the inner side face thereof and below the second extension (11') and a second connection rod (15) formed between the first extension (11) and the second extension (11') and defining therein a passage (150) and an elongated cutout (152) defined in a bottom face forming the passage (150). A first recovery spring (17) is mounted around the first connection rod (14).

A lever (16) is provided to the assembly seat (10) and has an extension hole (161) corresponding to and aligned with the second extension (11'), two notches (162) respectively defined in two opposite sides defining the extension hole (161) to respectively receive peripheral edges of the two ribs (12), a first end (163) formed at a bottom portion of the lever (16) to have a window (164) extended therethrough to communicate with the extension hole (161) and a second end (165) formed on a top portion of the lever (16) to extend into the passage (150) from the cutout (152) of the assembly seat (10).

Figure 3:
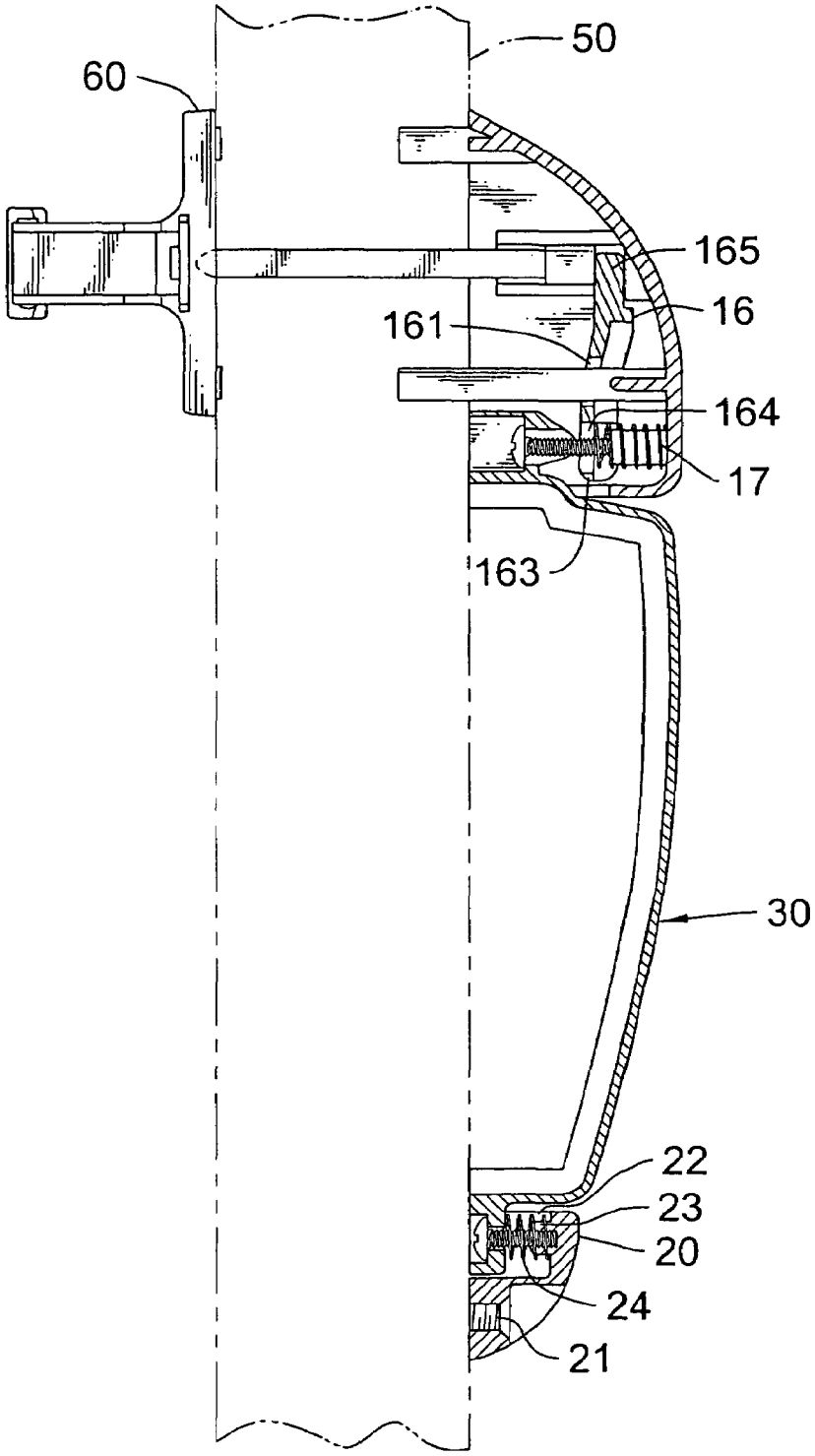
FIG. 3 is a schematic cross sectional view showing the connection between the base seat and the handle.

Still referring to FIGS. 1 and 2, and additionally FIG. 3, the base seat (20) has a hole (21) defined to correspond to and aligned with the first connection rod (14) of the assembly seat (10), a second assembly hole (22) defined in a top face thereof, a third connection rod (23) extending from an inner side face of the base seat (20) to have a second recovery spring (24) mounted therearound.

The handle (30) has a first end (31) formed on a top portion thereof and provided with a pointed triangular end (312), a first through hole (314) defined through the triangular end (312), and a second end (33) formed on a bottom portion thereof and provided with a second through hole (332) defined through the second end (33). A first threaded bolt (32) is to extend through the first through hole (314) and a second threaded bolt (34) is to extend through the second through hole (332).

Figure 4:
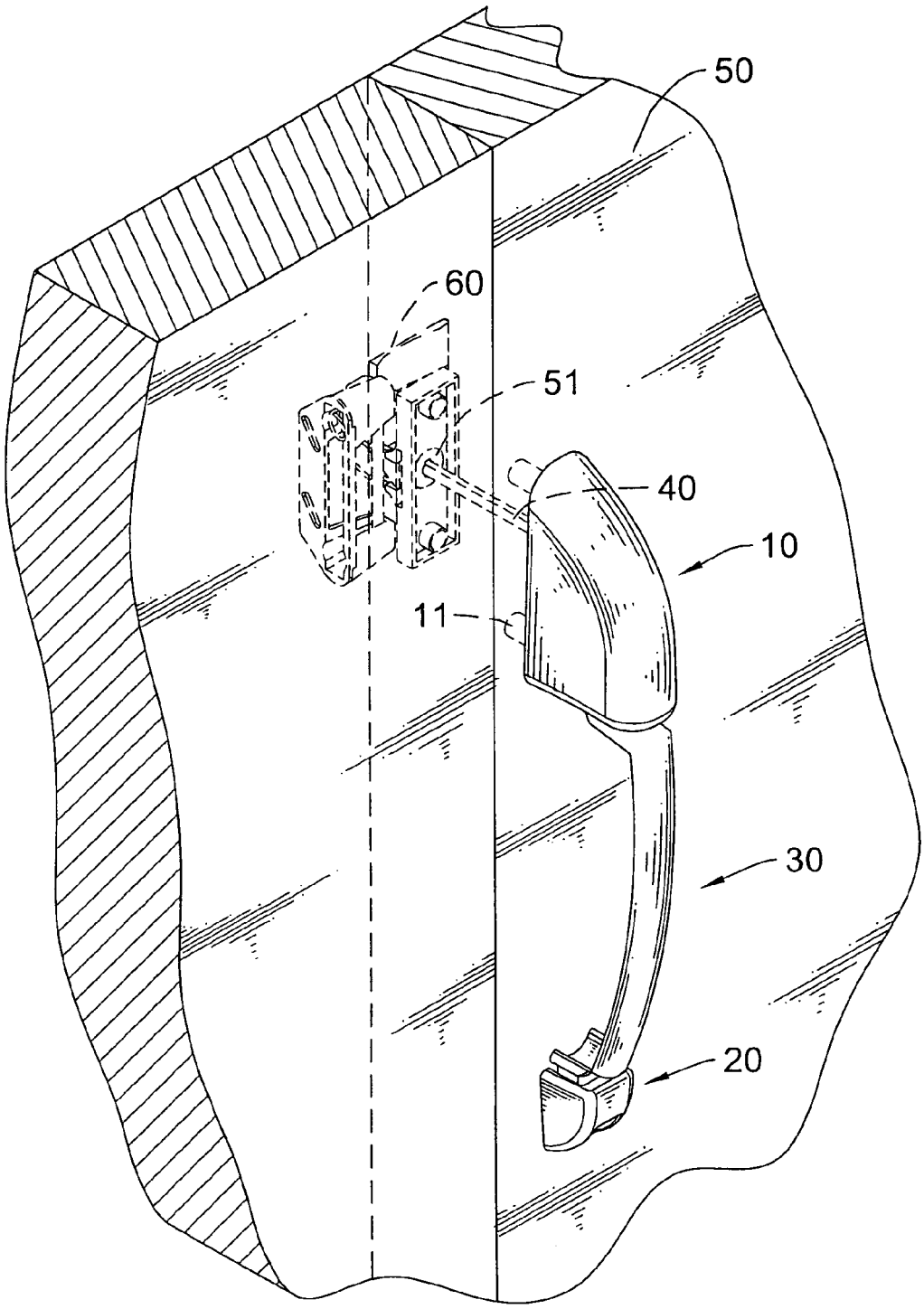
FIG. 4 is a schematic view showing the application of the activating assembly of the present invention on a screen door.

With reference to FIGS. 3 and 4 and still using FIG. 2 for reference, it is noted that when the activating assembly of the present invention is assembled to a screen door (50), a first end of a driving rod (40) is extended through the screen door (50) and into a lock device (60) also mounted on the screen door (50) to be opposite to the activating assembly of the present invention and a second end of the driving rod (40) is inserted into the passage (150) of the second connection rod (15). Before the first extension (11) and the second extension (11') are both extended into the screen door (50) to allow the assembly seat (10) to have a firm connection to the screen door (50), the first threaded bolt (32) is extended through the first through hole (314) of the first end (31) of the handle (30), the window (164) of the lever (16) and into the first connection rod (14) which has the first recovery spring (17) mounted therearound. Due to the outer threads of the first threaded bolt (32), the extension of the first threaded bolt (32) causes a threading connection between the first threaded bolt (32) and the first connection rod (14).

Before the first threaded bolt (32) is extended through the window (164) of the lever (16), the second end (165) of the lever (16) is extended through the cutout (152) and into the passage (150). After the first threaded bolt (32) is extended through the window (164) of the lever (16) to have threading connection to the first connection rod (14) while the first recovery spring (17) is mounted around the first connection rod (14), the triangular end (312) of the handle (30) is abutted against a side of the lever (16) and the ribs (12) of the assembly seat (10) are respectively received in the corresponding notches (162) of the lever (16). Then the second threaded bolt (34) is extended through the second through hole (332) and the third connection rod (23) of the base seat (20) while the second recovery spring (24) is mounted around the third connection rod (23). Thereafter, a securing bolt (as shown in FIG. 3) is extended through the hole (21) of the base seat (20) to allow the second end (33) of the handle (30) to have a firm connection to the screen door (50).

Figure 5:
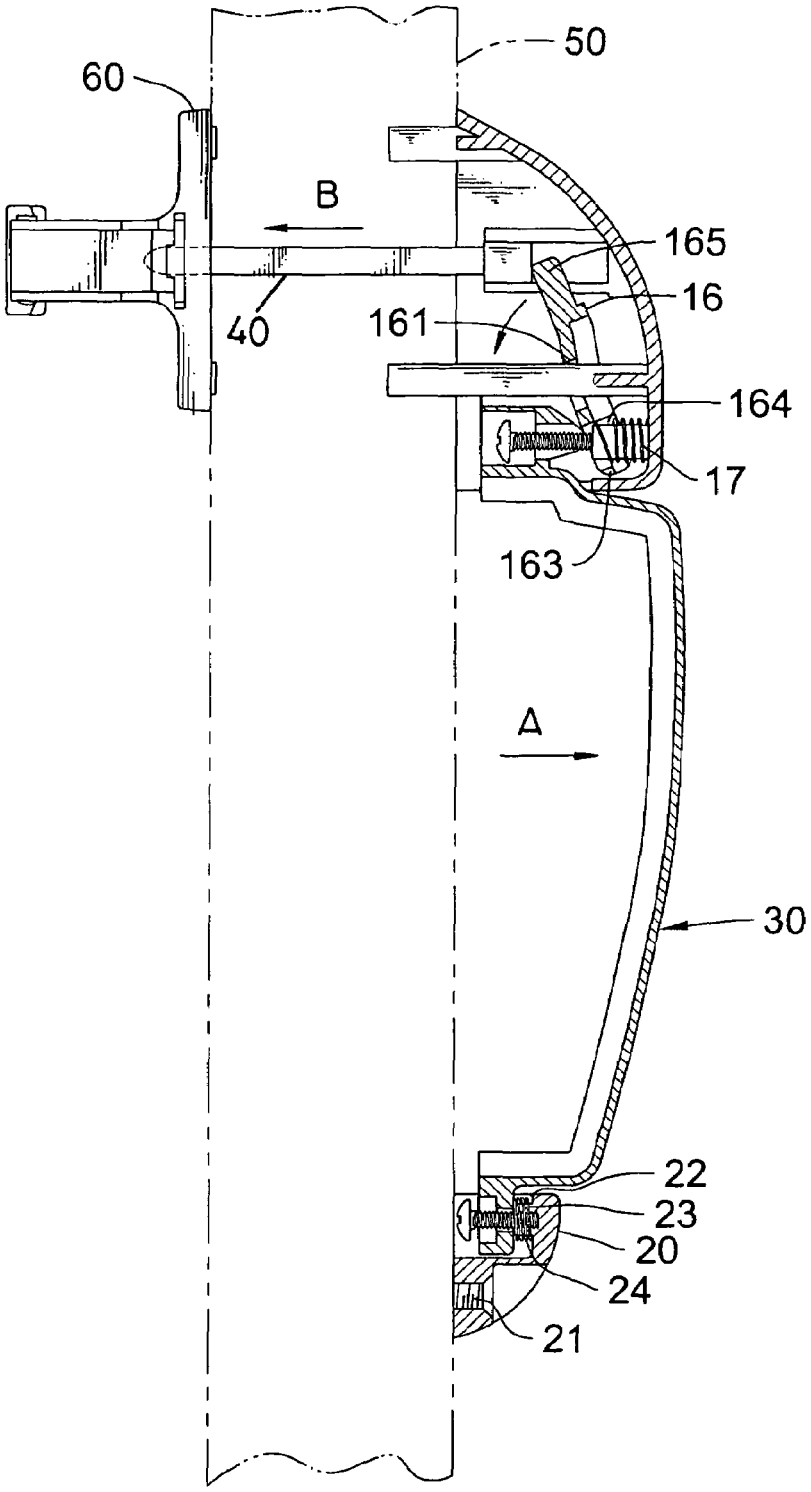
FIG. 5 is a schematic view showing that after the handle is pulled, the driving rod from the assembly seat is driven to deactivate the lock device.
Figure 6:
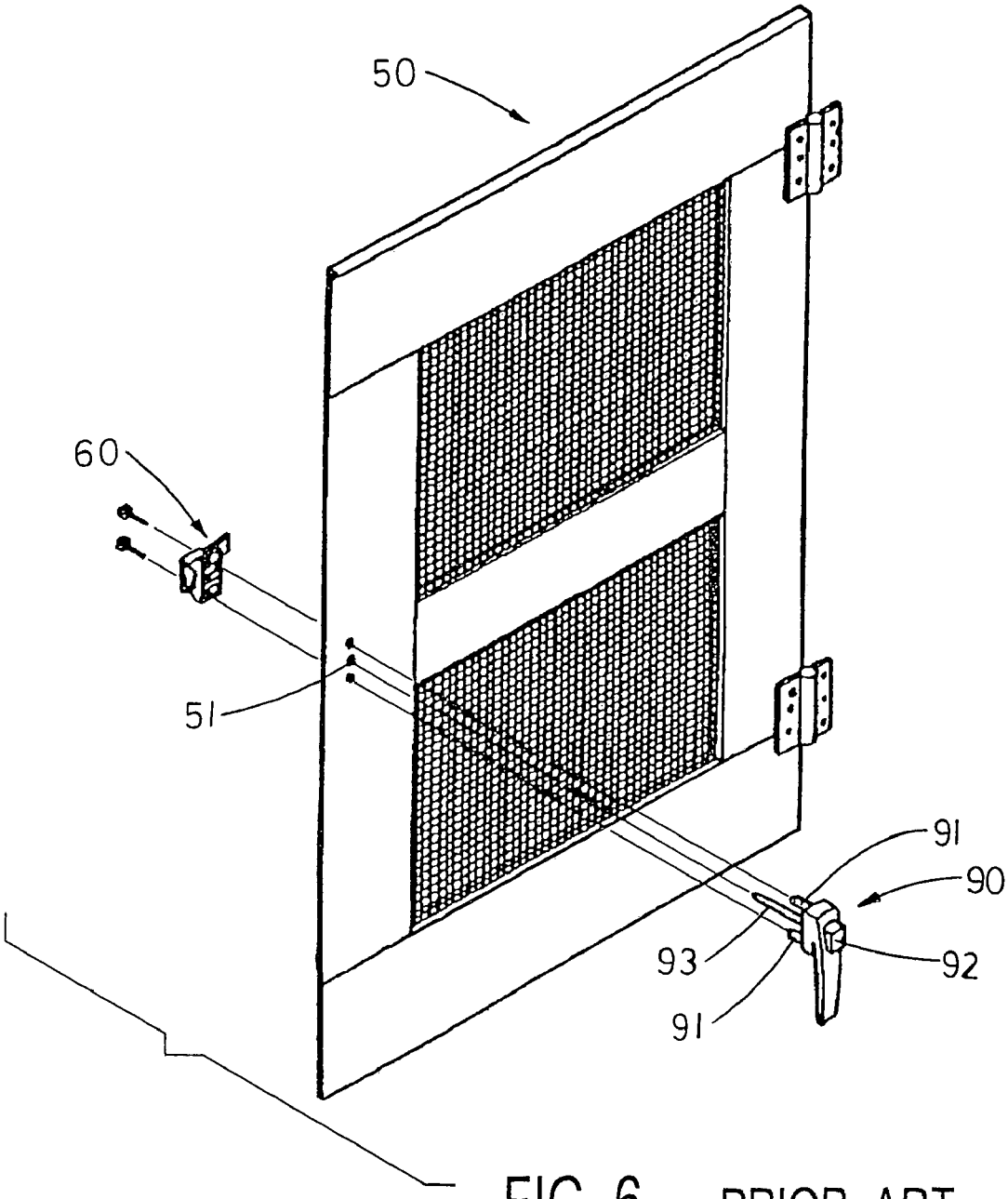
FIG. 6 PRIOR ART
FIG. 6 is an exploded perspective view of a conventional activating assembly.
Figure 7:
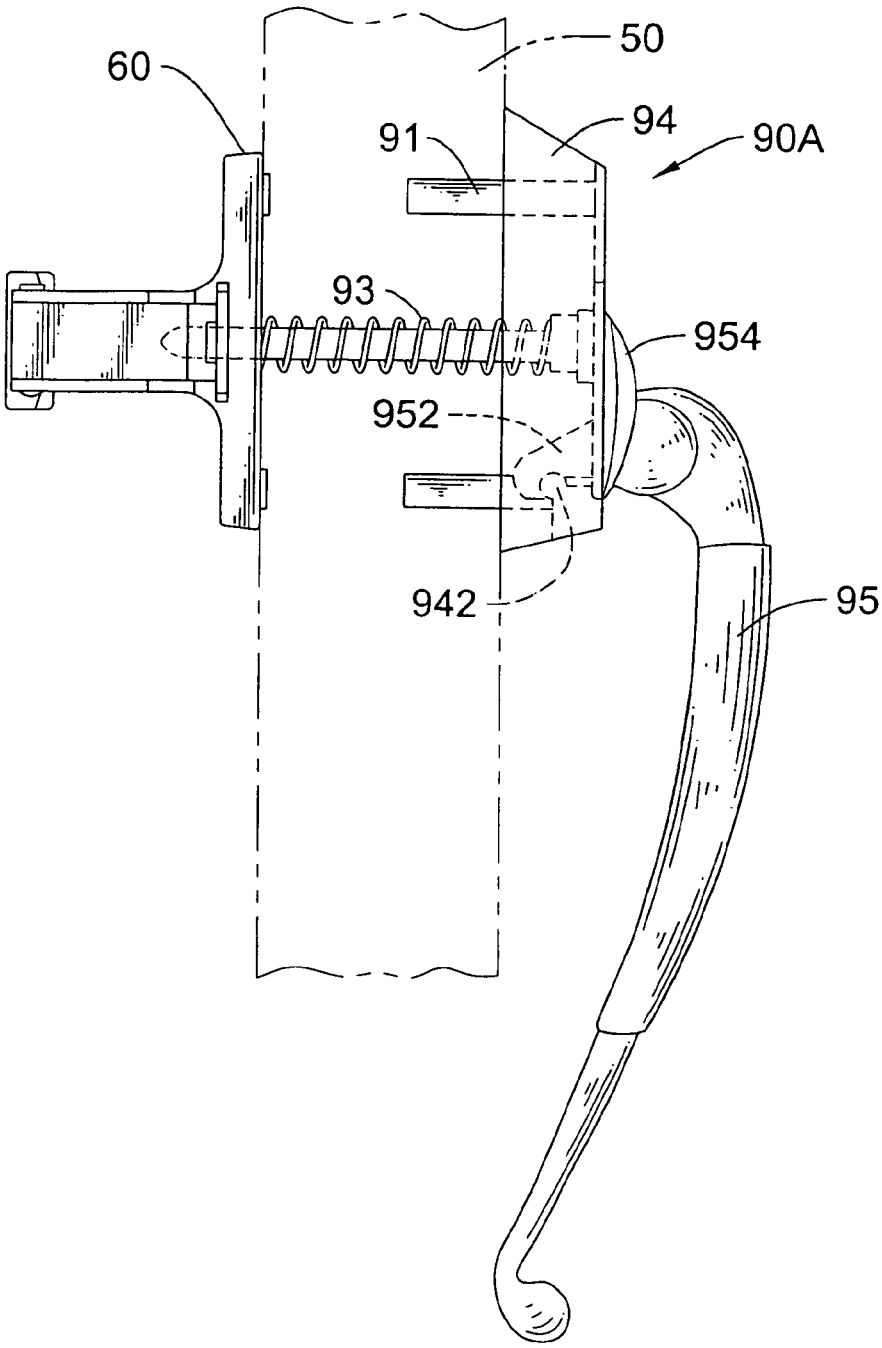
FIG. 7 PRIOR ART
FIG. 7 is a schematic side view showing a different conventional activating assembly to activate the lock device.

With reference to FIG. 5, it is noted that due to the first recovery spring (17) and the second recovery spring (24), the handle (30) is able to be pulled (moved) in a direction as indicated by arrow A. While the handle (30) is moved, the triangular end (312) of the first end (31) of the handle (30) forces the first end (163) of the lever (16) to move accordingly. However, due to the ribs (12) of the assembly seat (10) being received in the notches (162) of the lever (16) so that the lever (16) is pivoted to allow the second end (165) to move in a direction opposite to that of the first end (163). Again, because the second end (165) of the lever (16) is extended into the passage (150) and a free end of the driving rod (40) is received in the passage (150) to engage with the second end (165), the movement of the second end (165) of the lever (16) forces the driving rod (40) to move in a direction as indicated by arrow B, which is opposite to that of arrow A. Movement of the driving rod (40) activates the lock device (60). Due to the structure and operation of the lock device (60) being conventional in the art, detailed description thereof is omitted for brevity.

From the above description, it is noted that single movement of the handle (30) allows the driving rod (40) to activate the lock device (60). The user is able to easily open the screen door with only one step of movement of the handle. There is no requirement to push any pushbutton and then pull the handle, whereby operation of the handle of the present invention is easy and convenient for the user.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A handle activating assembly for a screen door, the activating assembly comprising:

an assembly seat securable to the screen door and having a lever movably received in the assembly seat and a first recovery spring a first end of which is abutted to a first end of the lever to push the lever back to its original position and a second end of which is abutted against an inner face of the assembly seat;

wherein the assembly seat has a first connection rod extending from an inner face of the assembly seat and the first recovery spring is mounted around the first connection rod, a first threaded bolt is extended through the lever and threadingly into the first connection rod to have the first recovery spring sandwiched between lever and the inner face of the assembly seat;

a driving rod a first end of which is adapted to extend through the screen door for connection to a lock device and a second end of which is connected to a second end of the lever such that movement of the lever is able to force the driving rod to cause reaction of the lock device;

a base seat securable to the screen door and having a second recovery spring compressibly received inside the base seat; and a handle movable relative to the assembly seat and the base seat, the handle having a first end provided with an end to abut the first end of the lever and a second end to sandwich the second recovery spring with the base seat such that the movement of the handle is able to compress both the first recovery spring and the second recovery spring and the lever is forced to pivot by a triangular end of the handle to drive the driving rod to move and the lock device is activated.

2. The handle activating assembly as claimed in claim 1, wherein the assembly seat has at least one rib formed with the inner face of the assembly seat to be received in a notch defined in the lever so that the lever is able to pivot.

3. The handle activating assembly as claimed in claim 1, wherein the assembly seat has a second connection rod integrally formed with the inner face of the assembly seat and having a passage defined to receive therein a free end of the driving rod and a cutout defined to communicate with the passage to receive therein the second end of the lever so that the second end of the lever is able to engage with the driving rod after passing through the cutout of the second connection rod.

4. The handle activating assembly as claimed in claim 2, wherein the assembly seat has a second connection rod integrally formed with the inner face of the assembly seat and having a passage defined to receive therein a free end of the driving rod and a cutout defined to communicate with the passage to receive therein the second end of the lever so that the second end of the lever is able to engage with the driving rod after passing through the cutout of the second connection rod.

5. The handle activating assembly as claimed in claim 4, wherein the base seat has a third connection rod extending from an inner face of the base seat and the second recovery spring is mounted around the third connection rod, a second threaded bolt is extended through a second end of the handle and into the third connection rod to sandwich the second recovery spring between the second end of the handle and the inner face of the base seat.

* * * * *